US011205529B1

(12) United States Patent
Rogerson

(10) Patent No.: US 11,205,529 B1
(45) Date of Patent: Dec. 21, 2021

(54) INSULATOR FOR A CABLE RACK

(71) Applicant: Cameron Rogerson, Madison, CT (US)

(72) Inventor: Cameron Rogerson, Madison, CT (US)

( * ) Notice: Subject to any disclaimer, the term of this patent is extended or adjusted under 35 U.S.C. 154(b) by 0 days.

(21) Appl. No.: 16/848,798

(22) Filed: Apr. 14, 2020

Related U.S. Application Data

(60) Provisional application No. 62/835,046, filed on Apr. 17, 2019.

(51) Int. Cl.
*H01B 17/00* (2006.01)
*H01B 17/14* (2006.01)
*H01B 17/56* (2006.01)

(52) U.S. Cl.
CPC ..... *H01B 17/14* (2013.01); *H01B 17/56* (2013.01)

(58) Field of Classification Search
CPC ..... H01B 17/14; H01B 17/56
See application file for complete search history.

(56) References Cited

U.S. PATENT DOCUMENTS 6,126,122 A 10/2000 Ismert
6,402,096 B1 6/2002 Ismert
6,446,915 B1 9/2002 Ismert
D506,385 S * 6/2005 Brown ..... D8/394
8,517,186 B1 * 8/2013 McCoy ..... H02G 3/263 211/60.1
8,550,259 B1 10/2013 McCoy
8,733,560 B2 5/2014 McCoy
10,186,850 B1 1/2019 O'Regan
2005/0211847 A1 * 9/2005 Pattie ..... H02G 3/32 244/129.1
2006/0091088 A1 6/2006 McCoy

OTHER PUBLICATIONS

Hubble, Incorporated, "Nylon cable rack insulator pad", brochure, year 2020, 2 pages.
Emerscan Engineering Inc. "Cable rack insulators" web page brochure, Jan. 2019, 1 sheet.
Hubble Power Systems Inc. / Chance, "Underground vault and manhole materials", Bulletin 5-53.7, Dec. 2002, 3 pages.

* cited by examiner

*Primary Examiner* — Pete T Lee
(74) *Attorney, Agent, or Firm* — C. Nessler

(57) ABSTRACT

An insulator for a bracket arm of a stanchion that supports an electrical or other cable has a combination of tab pairs with lips that grip a flange portion of the arm, to hold the insulator against vertical upward force, a base preferably comprised of special ribbing to carry vertical load, and downwardly extending leg pairs that slidably engage vertical surfaces of the arm, to resist lateral and twisting loads.

16 Claims, 7 Drawing Sheets

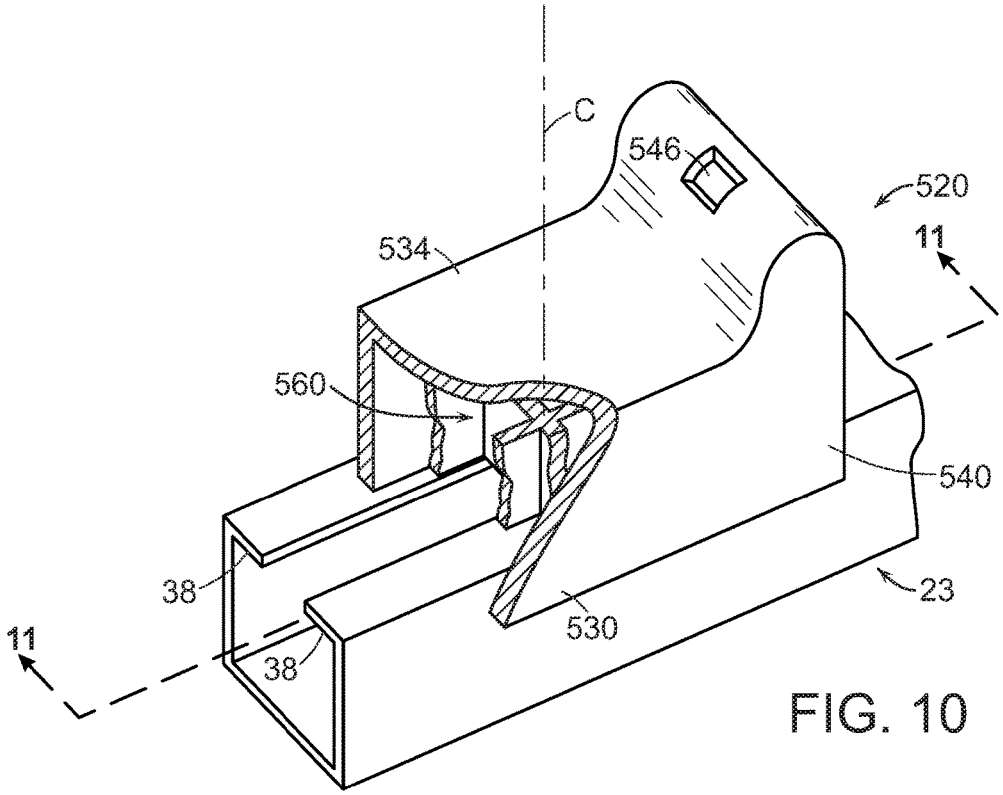
FIG. 10
FIG. 11
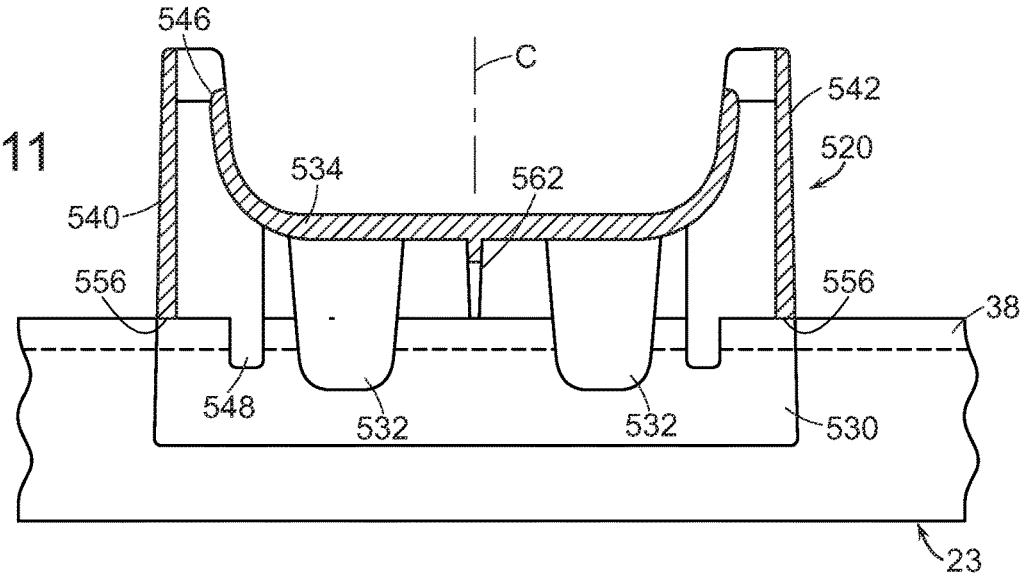

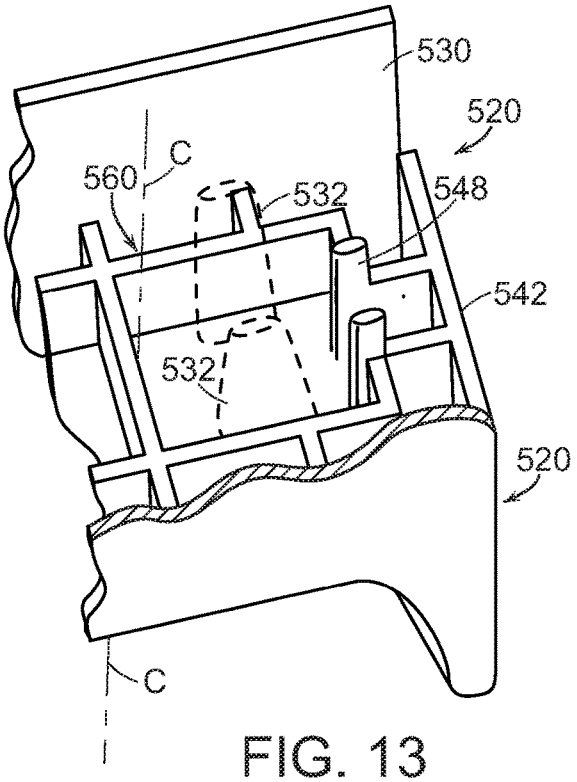
FIG. 13
FIG. 12
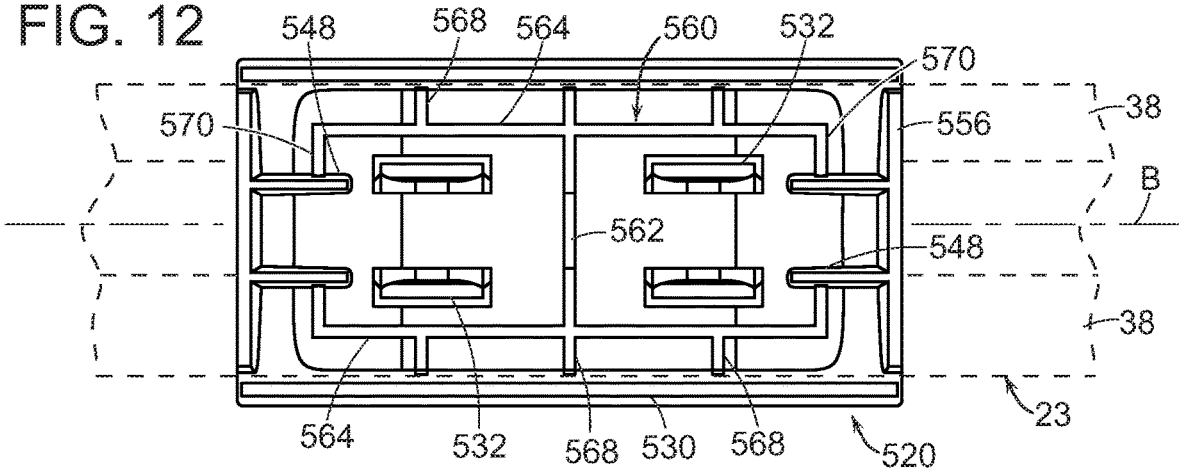
FIG. 12A
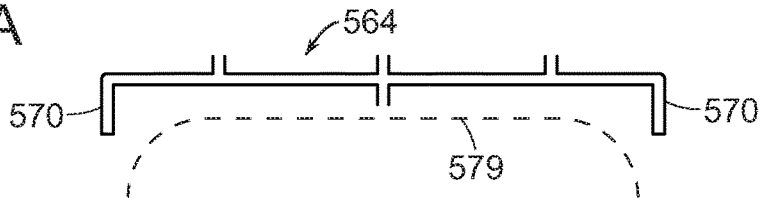

FIG. 14
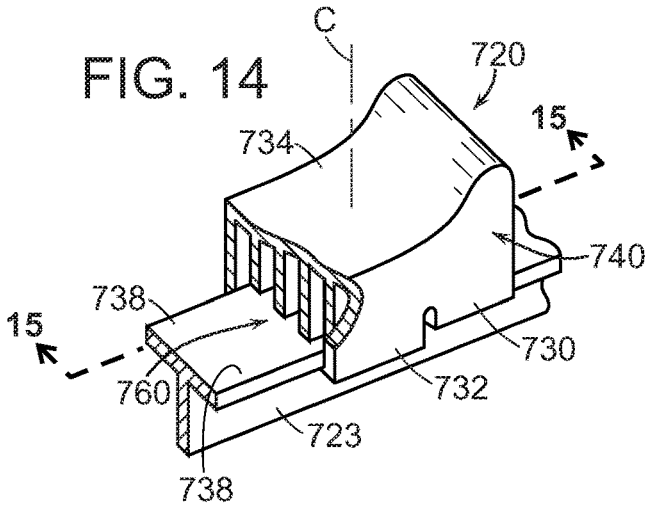
FIG. 15
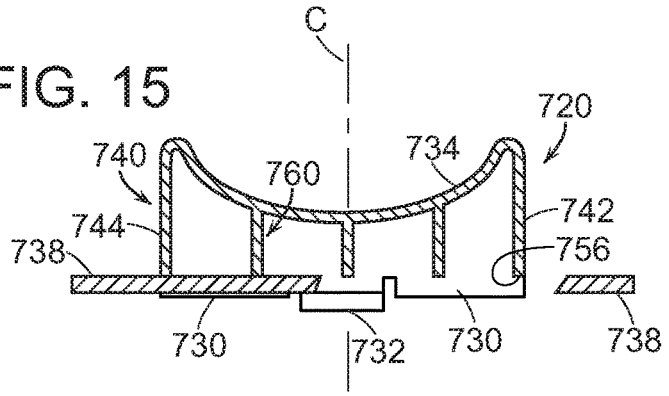
FIG. 16
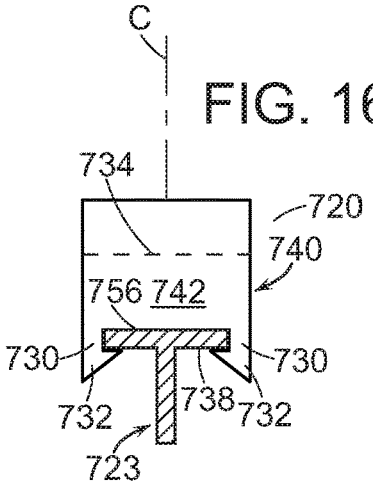
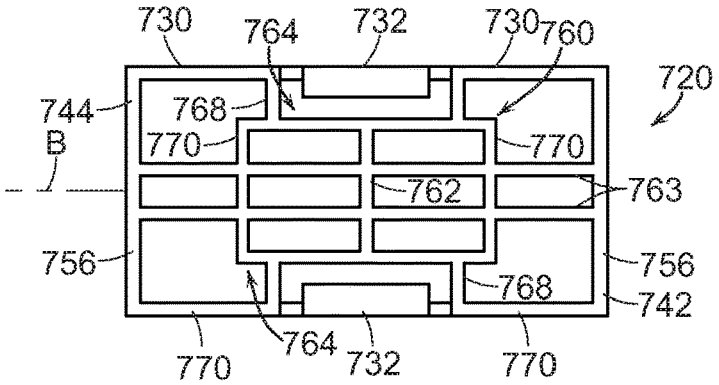
FIG. 17
FIG. 17A
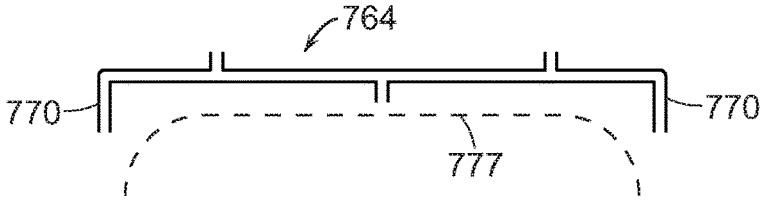

INSULATOR FOR A CABLE RACK

This application claims benefit of provisional patent application Ser. No. 62/835,046, filed Apr. 17, 2019.

TECHNICAL FIELD

The present invention relates to racks and associated insulators that are used for supporting cables, particularly electric cables, which are installed in underground tunnels, vaults and manholes.

BACKGROUND

In the distribution of electric power, electric current is often carried in sheathed, heavy, high voltage and low voltage electric cables which are put in underground tunnels or other kinds of passageways. One mode of supporting such cables is to run them between spaced apart arms or brackets which cantilever horizontally from vertical stanchions that are affixed to the wall of the underground passageway. The stanchions with projecting arms are commonly referred to as cable racks. Such kind of racks may be used for supporting conduits and other-than electric power cables, for instance, optical and telecommunication cables.

McCoy U.S. Patent Publication 2006/0091088 and McCoy U.S. Pat. No. 8,550,259 describe arrangements of stanchions and arms which are made of polymer material, compared to more familiar cable racks of the same general design, which are made of metal.

Numerous already-installed cable racks comprise metal stanchions and metal brackets. Many utilities still favor them for new or replacement installations. When a cable rack is made of metal, it has been customary to provide an electrical insulator on the top of a horizontal bracket. Familiar insulators have a top surface which is saddle-shaped, like that of a plastic saddle in FIG. 4 of the McCoy U.S. Pat. No. 8,550,259. Typically, the insulator is made of ceramic, preferably porcelain. A familiar insulator has a U-shape underside that sets in straddle-fashion atop the projecting cantilever metal bracket which commonly comprises a rectangular cross section channel.

Some prior art ceramic or hard plastic insulators have lips that extend inwardly from downwardly-extending insulator portions which straddle the exterior sides of a bracket. (Those portions are called legs in the description below). To install such an insulator, the user slides the insulator lengthwise onto the end of a bracket arm. However, when a first insulator is already in place and supporting a cable, a like second insulator cannot be readily put into the space between the first insulator and the wall of the tunnel, to support a second cable. It would be necessary to remove the first insulator while providing support for the cable, and then slide the second insulator onto the arm of the bracket of the rack.

Typically, prior art insulators made of fired ceramic only fit loosely on the horizontal arm of a rack bracket. To hold in place insulators which do not have the aforementioned tabs from becoming dislodged if the cable is jostled, and generally to keep insulators in place on a bracket, it is a familiar practice to use a line or filament as a tie that wraps around both the cable and the bracket.

The prior art ceramic insulators are heavy to transport and carry in the confines of tunnels, and are liable to be broken if dropped. And it is always an aim to reduce cost of the insulator and ease the labor associated with installing and using insulators.

SUMMARY

An object of the invention is to meet the needs cited and overcome the deficiencies mentioned in the Background, including to have an insulator that is easy to install, that resists inadvertent movement or dislodgement (and possible breakage), that holds cables in place, and that is sturdy and economic to make.

In accord with embodiments of the invention, an insulator for a nominally horizontal bracket arm of a stanchion that supports an electrical or other cable has a combination of downwardly extending tab pairs, the lips of which grip a flange portion of the arm; and downwardly extending leg pairs that slidably engage vertical surfaces of the arm. The tabs are configured to resist upward vertical force and the legs are configured to resist lateral and twisting loads. An insulator has a base for supporting the insulator on the top surface of an arm, and there is preferably a special ribbing that comprises C shape ribs, to carry vertical load.

In embodiments of the invention, an insulator has a contoured top surface, such as a saddle or U-shape, that faces upwardly; opposing ends are higher in elevation than is the center portion. There may be slots near each lengthwise end of the insulator for lines used to tie the cables to the top surface.

In embodiments, one or more tab pairs are disposed so tabs are spaced apart across the lengthwise centerplane of the insulator, which corresponds with the centerplane or an arm during use. Tabs of a pair, and legs of a pair, are arranged so they are across for each other with respect to the centerplane of the insulator. Depending on the configuration or arm, in particular, whether the flange edges face inwardly or outwardly, legs may be outboard or inboard of tab pairs. Preferably each tab is resiliently deflectable inwardly or outwardly so the insulator can be installed by pressing the insulator downwardly onto the arm. Likewise, the legs are configured to slide vertically along a vertical surface of an arm.

The foregoing and other objects, features, and advantages of the present invention will become more apparent from the following description of preferred embodiments and accompanying drawings.

BRIEF DESCRIPTION OF THE DRAWINGS

FIG. 10 is a perspective view of an insulator embodiment mounted on a bracket arm (in phantom), where the insulator is about half-cutaway.

FIG. 11 is a lengthwise cross section of the insulator shown in FIG. 10.

FIG. 12 is a bottom view of the insulator of FIG. 10.

FIG. 12A is a bottom view of a C shape portion of the insulator ribbing shown in FIG. 12.

FIG. 13 is a perspective view of a fragment of the bottom of the insulator of FIG. 10.

FIG. 14 is perspective view along the lines of FIG. 1, showing a portion of another embodiment of insulator as it is mounted for use on a bracket arm which has a T shape cross section.

FIG. 15 is an off-center lengthwise cross section of the insulator and arm of FIG. 14.

FIG. 16 is and end view of the insulator and arm of FIG. 14.

FIG. 17 is a bottom view of the insulator of FIG. 14.

FIG. 17A is a bottom view of a C shape portion of the insulator ribbing shown in FIG. 17.

DESCRIPTION

McCoy U.S. Patent Publication 2006/0091088 and McCoy U.S. Pat. No. 8,550,259, which are mentioned in the Background, are hereby incorporated by reference in their entireties. The description here uses as an example certain stanchion and arm constructions that are used to support electric cables. In the generality of the invention, other stanchion and arm constructions may be used and other kinds of conductors may be supported. Insulators of the present invention are preferably made of a polymer material, more preferably a thermoplastic such as polypropylene, polyethylene, filled nylon; or a thermoset polymer. Insulators may also be made of the other materials including composite materials that may include certain ceramics or glass, and possibly metallic materials.

Figure 1:
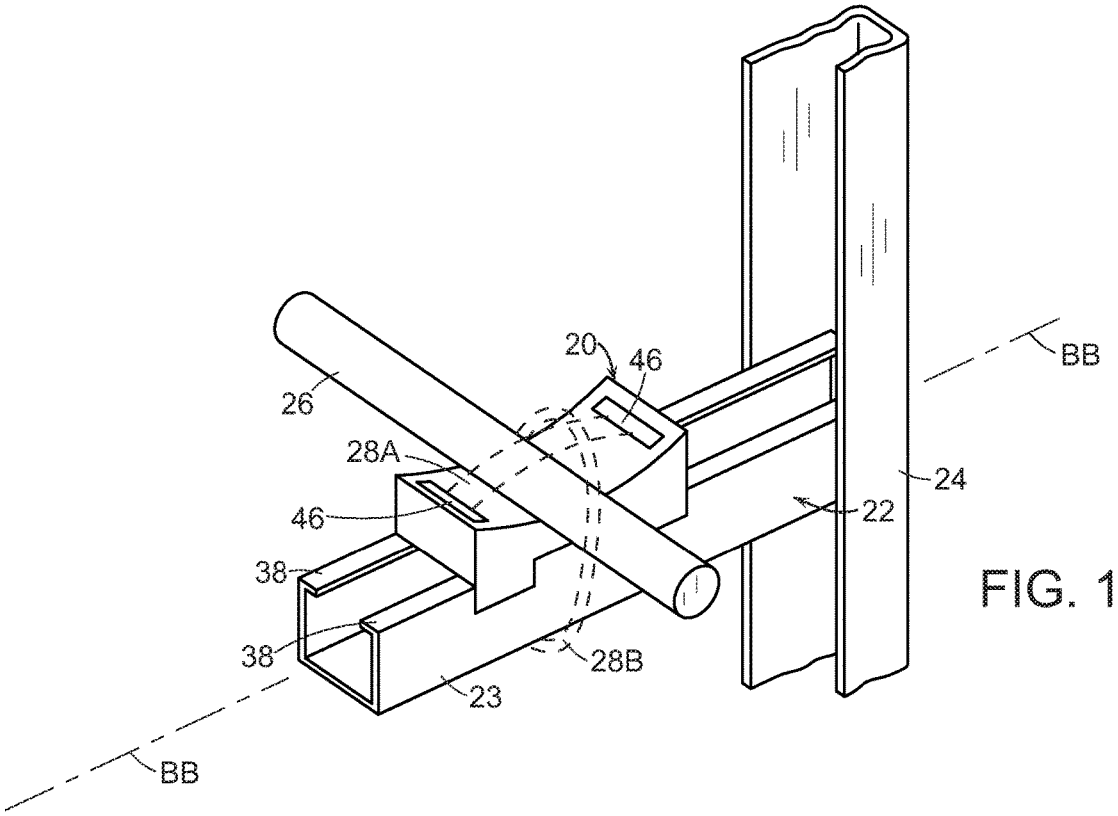
FIG. 1 is a perspective view of a portion of a rack holding a cable.
Figure 2:
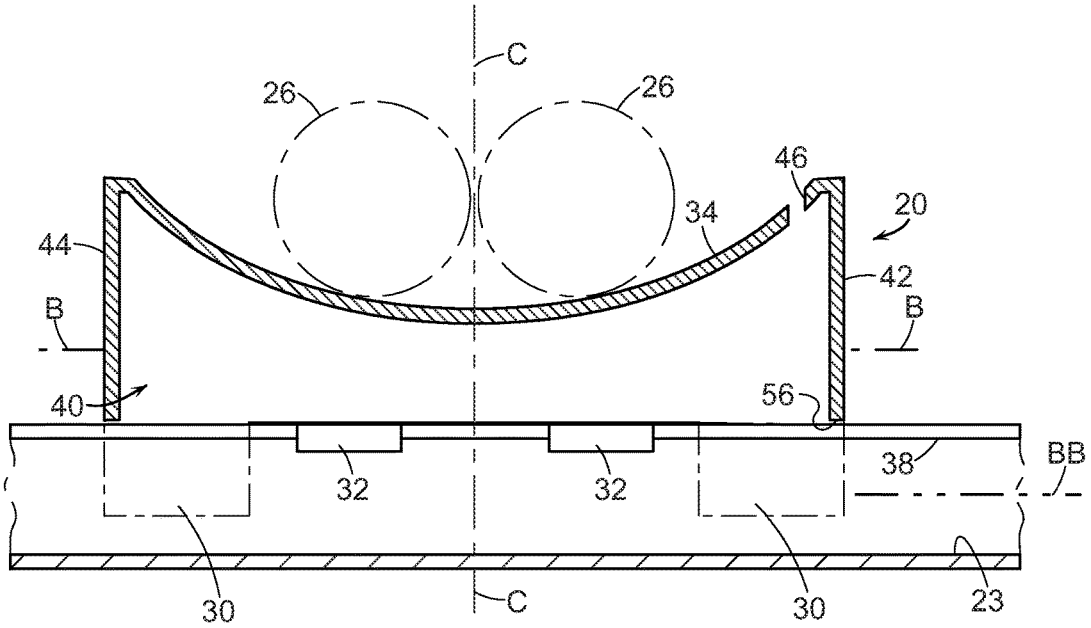
FIG. 2 is a side view of an insulator embodiment having on each side a pair of legs and a part of tabs with outward-facing lips.
Figure 3:
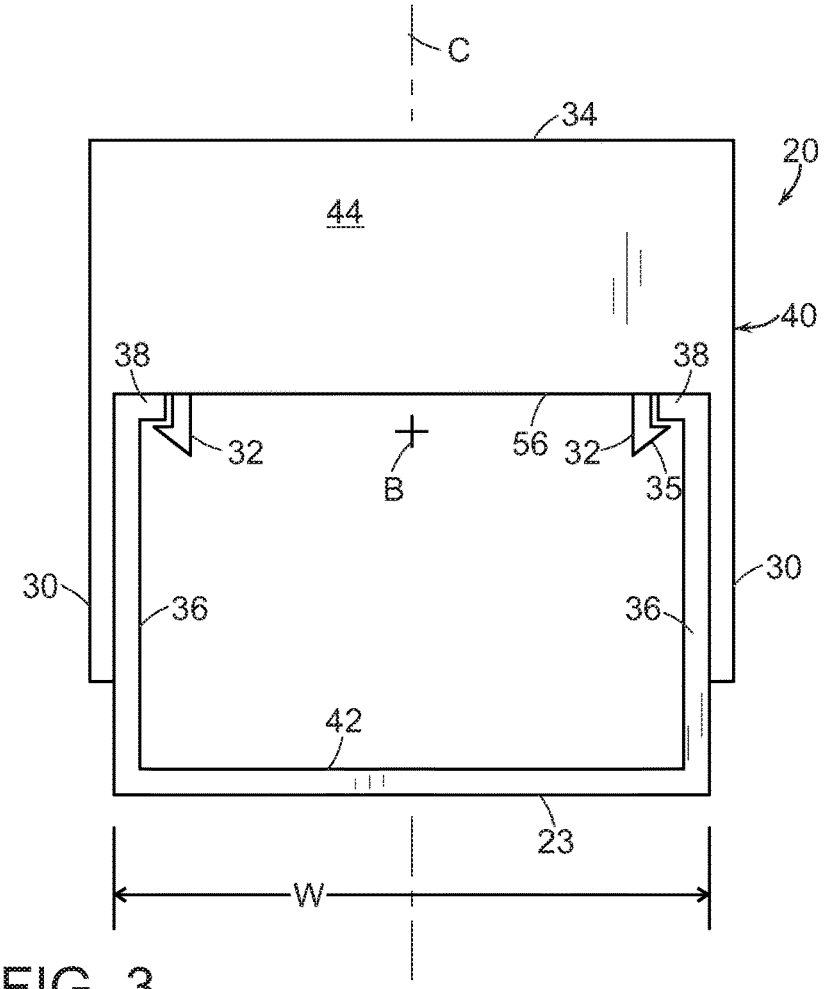
FIG. 3 is an end view of the insulator of FIG. 2 mounted on and engaged with the inner edge of and arm beam.

FIG. 1 is a simplified perspective view of a portion of cable rack stanchion 24 having a bracket 22 which comprises cantilever arm 23. For convenience, an arm may be characterized herein as running "nominally horizontally," intending to include situations where an arm runs from the stanchion at a low upward angle. Insulator 20, an embodiment of the present invention, is supported on the arm to support a cable 26. FIG. 2 is a side view and FIG. 3 is an end view of insulator 20, all showing the configuration of the insulator and how it mounts on an arm which arm is not part of the present invention. FIG. 2 is a lengthwise cross section, now showing in phantom two cables 26.

Arm 23 is one type of arm, namely a channel having a nominally U-shape cross section with an upward facing concavity. The concavity opening may be characterized as a lengthwise slot opening, defined by the edges of opposing inwardly extending flanges 38. Arm 23 has opposing lengthwise vertical sides 36 and a central length axis BB which lies in the vertical centerplane of the arm. Arm 23 and other arms may have a multiplicity of perforations in the vertical running sides 36 and bottom portion for lightening and for enabling things to be secured to the bracket, as are familiar for commercial structural channel products.

Typically, as familiar to those in the field of electric power distribution, the vertical location of bracket 22 is adjustable along the vertical length of the stanchion. In a typical cable rack system comprising stanchions and brackets like those shown in FIG. 1, many stanchions 24 are spaced apart laterally along, and secured to, the wall of a tunnel or of a passageway or of a building or other structure.

Each stanchion will typically have a multiplicity of brackets spaced apart vertically. In side elevation view, a bracket may have an L-shape: one leg of the bracket cantilevers outwardly as the arm. the other leg runs vertically along the stanchion and is configured for being adjustably secured to the stanchion in ways which are well known.

During use, insulator 20 sets upon the top of the arm 23 of bracket 22, as exemplarily shown in FIGS. 1 to 3. Insulator 20 has a central lengthwise axis B and a central vertical axis C. Both axes lie in the vertical centerplane of the insulator. As shown, an electric cable 16 runs cross-wise to the bracket arm lengthwise axis BB, and rests on top of insulator 22 which sets on, and is engaged with, the bracket in ways that are described further, below. Axis B of the insulator and axis BB of the arm are parallel during use of the insulator. Cable 26 is optionally held in place on insulator 20 by a tie 28A that runs through slots 46 at opposing ends of the top of the insulator. Alternatively, a cable may be held in place by tie 28B which runs around the insulator and the arm portion of the bracket; or by a combination of the two types of ties, or by other tie configurations.

Insulator 20 has a body 40 which is that portion of the insulator which comprises all the structure above the base plane; i.e. excluding legs and tabs which descend downwardly from the body. The base plane mates with the top surface of an arm and lies in the plane of the length and width dimensions of the insulator. The bottommost portion of the base comprises that surface portion of the body which lies in the base plane, to support the insulator on the surface of an arm. As indicated by the partial cutaway of FIG. 2, the insulator 20 preferably has a molded wall defining a hollow interior. The wall has a thickness sufficient to provide strength for the intended application. As described below there may be internal ribbing, or it may be absent as in insulator embodiment 20. Bodies as pictured here which have interior concavity with or without ribbing have the advantage of lower material costs and typical easier fabricability. A solid body is not excluded in carrying out the invention. Exemplary insulator 20 of the present invention may have an overall height of about 3 inches, a width of about 2.5 inches, and a length of about 5 inches. Other insulators may have different dimensions, suited to a particular bracket configuration or to particular cable(s) or other supported things.

Figure 4:
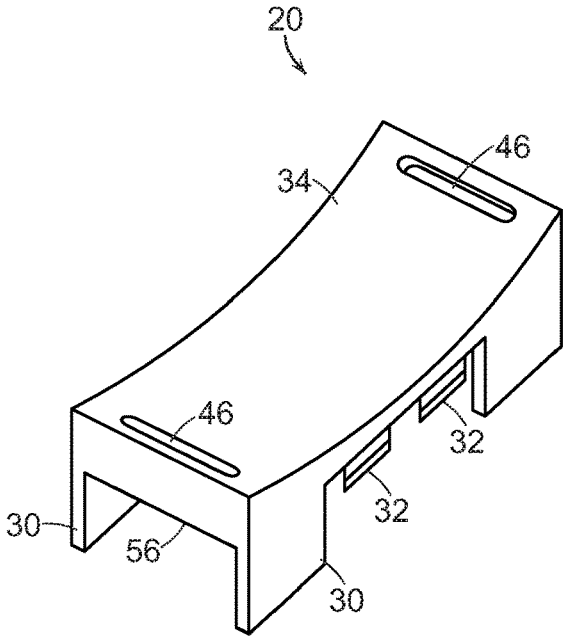
FIG. 4 is a perspective view of the insulator of FIG. 1.

FIG. 4 is a perspective view looking down on insulator 20. An insulator has a contoured surface shaped for restraining cable movement in the insulator lengthwise direction. Insulator 20 has a concave-curved or saddle-shape top surface 34 that runs from a first end 44 to a second end 42. By saddle shape is meant that the top surface is higher in elevation at each end than the mean surface elevation. The surface contour is preferably symmetrical about the vertical central axis C but may be otherwise. In other alternative embodiments the top surface curve may have more or one widthwise running humps to keep two cables spaced apart from each other.

The base of insulator 20 comprises base plane structure that supports the insulator during use by resting on the top surface of an arm. The opposing end surfaces 56 comprise such structure in insulator 20. In other embodiments of the invention, there is ribbing within the concavity of a body, and part of all of the ribbing will have lower end surfaces which comprise the base of the body, and which surfaces lie in the base plane. See further, the description relating to insulator embodiment 520 below.

As shown in FIG. 2 and FIG. 4, preferably there is at each end of the insulator a slot opening 46 that is suitable for receiving a line which acts as a tie, such as tie 28A mentioned above. A tie running through a slot will preferably run along the underside of the insulator, to help hold the cable to the insulator. Also, a tie may run through around the arm and through perforations in the side or bottom the arm when such are present, supplementing the function of the tabs in holding the insulator and cables in place.

Legs 30 extend downwardly from, and run lengthwise along, each opposing side of insulator body 40. The inside surfaces of the legs have a spacing which fits slidably the vertical surface sides of arm 23, which has outside dimension width W, without gripping or latching to the arm. Referring further to FIG. 3, insulator 20 comprises two legs spaced apart from each other across the insulator centerplane and lengthwise centerline B. As described above there may be more than one pair of legs.

Visible in the space between the legs 30 are a pair of spaced apart tabs 32. In the insulator 20 embodiment there are four such tabs, but there optionally may be only one pair. Each tab 38 has a lip 35 that has an angled end which extends outwardly from the central B axis, for engaging a flange 38 at the edge of the channel structure of the arm when the insulator is in position for use. The lower edge of lip 35 is angled in the transverse plane of the insulator and, when the insulator is made of resilient plastic, the tabs are deflectable as the insulator is pressed down onto the open top of an arm: As an insulator is pressed downwardly onto a top portion of an arm, the tabs will first elastically deflect inwardly from a home position (that position, at which, the tabs are at rest prior to installation). Then, when the base of the insulator comes into contact with the top surface of the arm, they resiliently spring outwardly in the direction of their home positions, to engage the lengthwise edges of flanges 38 of the arm. The tabs thus make the insulator resistive to vertical lifting from the arm top surface. At the same time, the aforesaid engagement feature allows the insulator to be moved lengthwise along arm 23 without lifting and removal from the arm. The other embodiments of insulators described herein generally function in a similar manner, insofar as tab resilient action is concerned.

Alternatively, an insulator made from rigid non-resilient material can be engaged with the arm by sliding it lengthwise onto the free end of the arm. In such instance, the tabs do not have to be deflectable. While two pairs of tabs are shown in the Figures, an insulator of the present invention may have only one pair, or may have additional pairs, of tabs.

Figure 5:
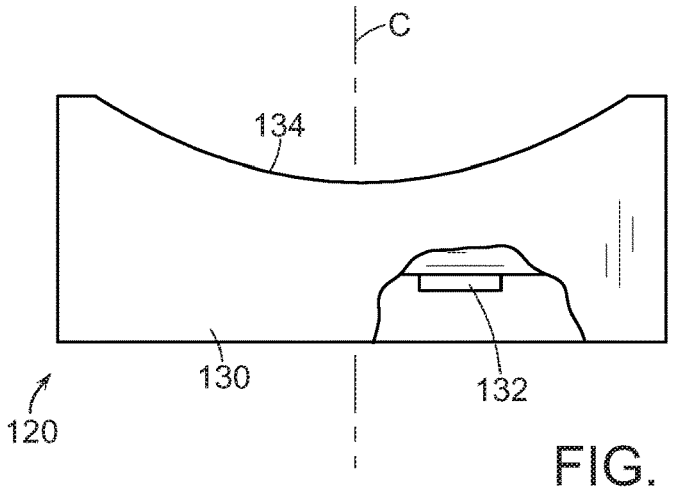
FIG. 5 is a side view of an insulator like that of FIG. 1, partially cutaway, to show a single leg running the length of each side of the insulator.

FIG. 5 shows, in side elevation view, an embodiment of insulator 120 which is much like insulator of FIG. 2. Each opposing side leg 130 is continuous from one lengthwise end of the insulator to the other.

Figure 3A:
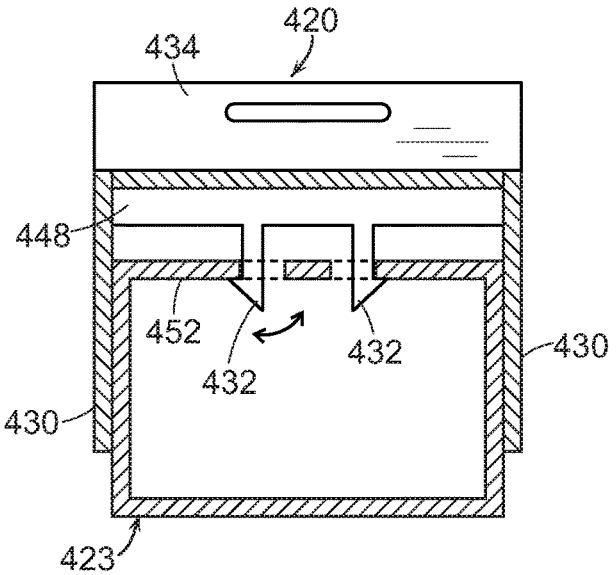
FIG. 3A is an end view cross section, showing another configuration of bracket arm with an insulator that has tabs which engage the top of the arm by passing through slots in the arm top.

FIG. 3A is an end view cross section at the mid-point of an insulator 420 embodiment. Insulator 420 is mounted on arm 423, which has different configuration from the bracket arm 23. The arm 423 is box-like in cross section and has a top 452 with parallel lengthwise-running, spaced apart, slot perforations, within which tabs 432 are positioned. The inward-extending portions of top 452 that define the outer edges of slots are treated as flanges of the arm with respect to the claimed invention.

Insulator 420 has on each opposing lengthwise side a leg 430. Insulator 420 has at least two tabs 432, spaced apart on either side of the lengthwise centerline B. In insulator 420, each tab 432 descends from an interior cross rib 448 and has a lip end, the extension and angle portion of which faces outwardly relative to the lengthwise centerline of the insulator. A tab 432 fits into each lengthwise slot. Tabs 432 are configured to spring resiliently inwardly, then outwardly, as indicated by the curved arrow, when insulator 420 is pressed downwardly onto the top of arm 423, thus holding the insulator to the top of the arm. As shown in FIG. 3 and FIG. 3A, the legs are spaced apart from the centerplane a greater distance than are the tabs.

Alternatively, legs of insulator 420 may have other configurations, including those already described herein, so the insulator is held and guided with respect to the exterior vertical surface of the arm. In another embodiment of insulator, not pictured, configured for an arm like arm 423, the lip ends of the tabs face inwardly instead of outwardly; and the tabs deflect in the opposite directions from what was just described.

Figure 6:
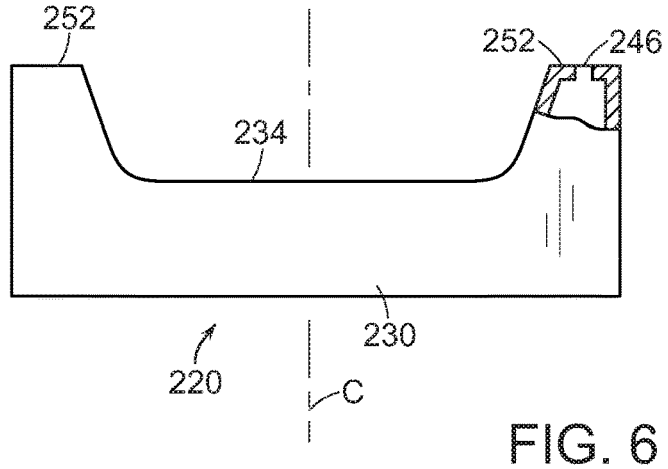
FIG. 6 is a side view like that of FIG. 5 where the insulator 220 has a leg 230 like that of FIG. 5 and the top surface 234 is U shape, and at each end are flats with slots 246.

FIG. 6 shows insulator 220 which has an alternative concave contour top surface 234 that is U shape. The insulator has a continuous leg 230 on each lengthwise side. There is a flat portion 252 at each end, each optionally having a slot 246 for a tie. Other insulators may have a slot at only one end. Other insulators may be substantially flat surfaced.

It will be appreciated that, in this and other embodiments, that while the tabs will to an extent resist lateral or twisting surfaces relative to the flat top surface of an arm, the legs are intended to better and to predominately resist such forces. Thus, to resist twisting loads it is particularly advantageous to have on a side of the insulator either a continuous leg (when a tab(s) is inboard of the leg relative to the centerplane) or two spaced apart legs with the tab(s) positioned in between the legs, when the tabs and legs on a side lie in the same vertical lengthwise plane.

With respect to vertical loads, the base plane portions of the insulator carry the downward load, while the engagement of tab lips with the underside of a flange edge resist any upward load.

Figure 7:
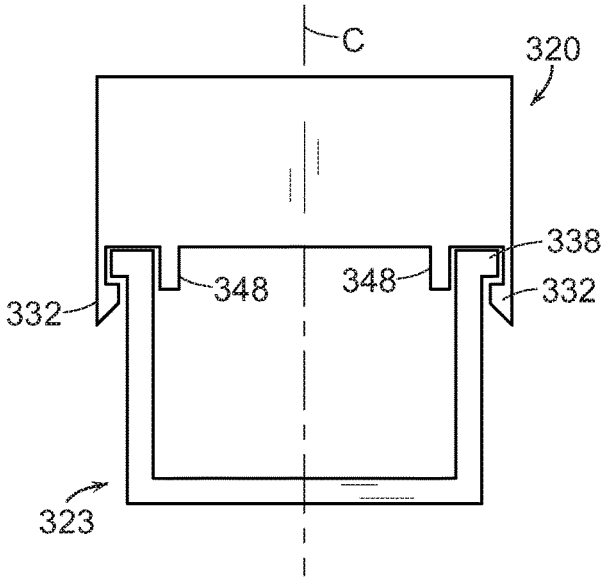
FIG. 7 is an end view like FIG. 3 showing another embodiment of insulator where the tabs engage the exterior of the arm.

Some arms may have the cross section of arm 323, shown in the FIG. 7 end view; the flanges 338 of the arm extend outwardly from the lengthwise centerline of the arm. To mount a cable to such an arm, insulator 320 may be used. Insulator 320 has tabs 332 which descend from the exterior sides of the insulator body. Each insulator has a lip that extends inwardly toward the centerline of the insulator, thereby to engage the underside of outwardly extending flange 338 of channel shape cross section arm 323. At least a pair of opposing side legs 348 fit the interior surfaces of the arm, thereby to guide the insulator for possible lengthwise movement during installation or use of a cable.

Figure 8:
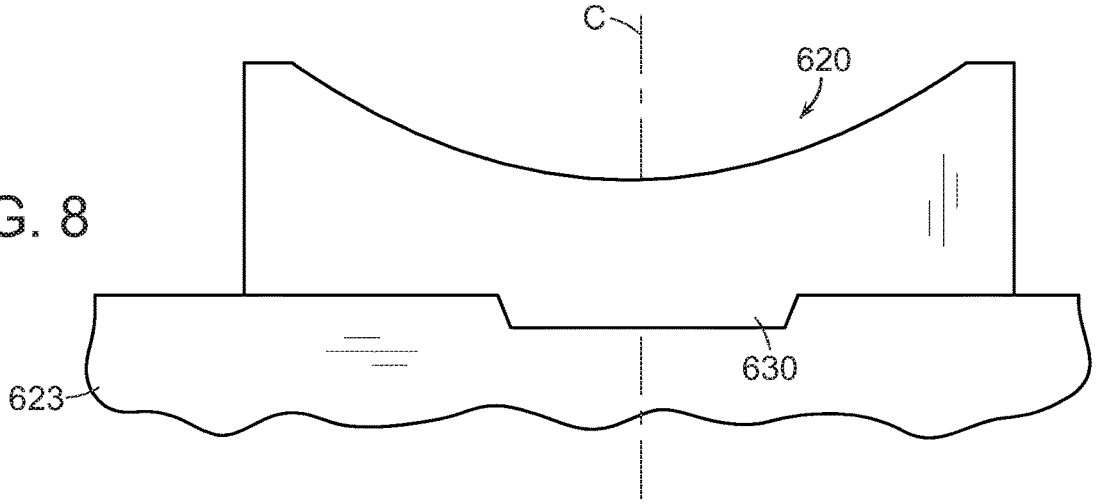
FIG. 8 is a side view of another embodiment of insulator, mounted on an arm.
Figure 9:
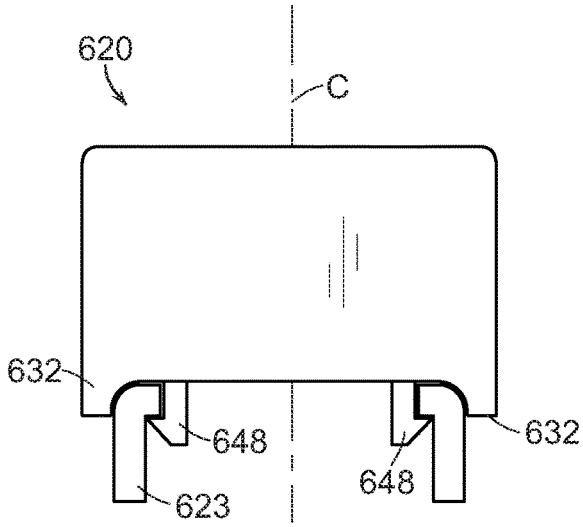
FIG. 9 is an end view of the insulator and arm of FIG. 8.

Returning again to insulators for use on arms with inward-facing flanges: FIG. 8 is a side view and FIG. 9 is an end view of insulator 620 which has a single central leg 630 on each opposing lengthwise side of the insulator, which is shown secured to arm 623. Insulator 620 has two tabs 648 with lips, to engage the inwardly extending flanges at the top of the arm.

FIG. 10 is a perspective view of insulator embodiment 520 mounted on bracket arm 22. The insulator is almost half cut-away to show the internal ribbing 560 which also serves to support the insulator on a bracket arm, as described below. FIG. 11 is a lengthwise cross section and FIG. 12 is a bottom view. FIG. 13 is a perspective view of the insulator turned upside-down.

Insulator 520 has a body which is essentially of thin-wall or shell construction, defining a saddle shape top surface 534 and opposing ends 540, 542. At each end of the saddle, at the highest point relative to the mean elevation of the saddle shape surface, there are opposing end slots 546 which are suitable for ties. Referring to FIGS. 10 to 13, within the concavity of the insulator 520 is ribbing 560 that comprises lengthwise running segments 564, cross segment 562, and link segments 568 that run to the side walls of the body. During use the planar lower surfaces of the ribs rest on lengthwise running top surfaces of flanges 38 of bracket arm 23. Rib segments 564 provide the major part of the support and an alternative embodiment may have only those rib segments or their equivalent. FIG. 12A shows how each rib segment 564 comprises perpendicular end sub-segments 570, thereby providing the rib segment with a C shape in the horizontal plane, as illustrated by the dashed line 579 which portrays a C. The C shape efficiently provides strength to the insulator, resisting buckling under load and enabling the insulator to support a cable load and maintain its shape over time.

The lower surface of ribbing 560 and bottom edges 556 of the opposing insulator ends lie in the same plane, which is the base plane of the insulator, to support the insulator and any cable load that is applied, by resting on the top surface of an arm. Thus, in this and analogous embodiments, the lower portion of the ends of the insulator may be considered to be part of the ribbing. On the other hand, in alternative embodiments, the bottom ends of the ribbing might be spaced apart upwardly from the top of the arm when their structural contribution is not needed. The ribbing also strengthens the saddle surface and sides of the insulator. The ribbing provides strength and stiffness while enabling economic use of material by avoiding excess weight which more solidity would incur. In the generality of the invention, alternative rib configurations may be used.

Four tabs 532 with lower end lips like those described above run downwardly beyond the base plane surface of ribbing 560, to engage the flanges 38 of arm 23 in ways described above. Opposing side legs 530 run lengthwise to engage the outer side edges of the arm. As mentioned, the legs 530 may have alternative configurations, namely on each side there may be a single full length leg (a continuous leg), a partial length leg, or two or more spaced apart legs (the latter being discontinuous legs). In insulator 520 there are four optional supplemental legs 548 that are extend downwardly from the plane of the ribbing. Legs 548 run along the internal edges of the flanges of the arm to help resist any twisting force in the plane of the top of the arm of a bracket.

FIGS. 14 to 17A show insulator embodiment 720, which is suited for use on a bracket arm 723 which has a T shape cross section comprising outwardly extending flanges 738. Insulator 720 comprises body 740 and a top surface 734 for supporting one or more cables. The body may have one or more openings, not shown, in the top surface, like those previously described. From each opposing lengthwise side of the insulator extends downwardly a tab 732 that has an inward facing lip, shaped to grip the underside of a flange 738 and hold the insulator in place. Straddling each tab in the lengthwise direction are a pair of spaced apart downwardly-extending legs. Legs 730 are configured to slide along the outer edge of a flange 738, to resist any force that is transverse to the length of the arm, more effectively than tabs do. The combination of legs and tabs also eases installing an insulator by pressing downwardly, compared to, for instance an insulator which has only one tab on each lengthwise side. In variations of insulator 720, there may be more than one tab on each side. For instance, there may be two spaced apart tabs on either side of a central leg instead to two spaced apart legs on either side of a central leg, as shown in FIG. 15. In embodiments of an insulator of the type of embodiment 720, there will be at least one tab on each side, and at least one leg on each side.

Ribbing 760 runs within the concavity of the interior of insulator 720. The lowermost surfaces of the ribbing, along with the lower surfaces 756 of the ends 742, 744, lie in a base plane of the body which is intimate with the top surface of the arm, thereby to support the insulator on the arm. In variations of insulator 720 there may be no ribbing; or there may be ribbing that has lower end surfaces which are not in the base plane; or there may be ribbing without also having lowermost surfaces of ends 742, 744 lying in the base plane; consistent with variations that have been mentioned above in connection with other insulator embodiments.

Ribbing 760 has a pattern which presents in the base plane, as shown in the FIG. 17 bottom view of insulator 720. There are four lengthwise parallel ribs: Two ribs 763 are proximate the center axis B; they run from one end of the insulator to the other. Two ribs 764 are outboard of, and parallel to, ribs 763. Ribs 764 run more than half of the length of the insulator. Ribs 764 have right angle end segments 770. The combination of length segment and right angle segments provides each rib 764 rib with a nominal C shape configuration in the base plane, as illustrated in FIG. 17A by the superimposed dashed C shape line 777. A C shape rib (along with link segments 768 contributes to providing an insulator with superior strength and resistance to distortion, while conserving weight and material cost.

Consistent with the description above, to put use an insulator into use, the insulator is pressed down vertically onto the top surface of an arm, so the tabs are deflected and resiliently engage the flanges to keep the insulator in contact with the surface, as the insulator reaches its installed/home position. At the home position, the base plane surfaces rest slidably on the top surface of the arm as the insulator. Alternatively, an insulator may be slid lengthwise onto the free end of the arm while the tabs engage the flanges. In either case, the legs fit closely with vertical surfaces of the arm. When the slot in the top surface of the arm is continuous, an insulator may be slid lengthwise along the slot-length of the arm.

An insulator of the present invention achieves the objects of the invention. When a first insulator is in place on the cantilever arm of a bracket, a second insulator made of resilient plastic material can be pressed downwardly into a space inboard of the first insulator. The combination of planar side legs and tabs and optional supplemental tabs provide strength in resisting twisting loads on the insulator. Vertical loads are resisted by the ends of the body of the insulator, and when present, ribbing that rests on the surface of the arm.

The invention, with explicit and implicit variations and advantages, has been described and illustrated with respect to several embodiments. Those embodiments should be considered illustrative and not restrictive. Any use of words such as "preferred" and variations suggest a feature or combination which is desirable but which is not necessarily mandatory. Thus, embodiments lacking any such preferred feature or combination may be within the scope of the claims which follow. Persons skilled in the art may make various changes in form and detail of the invention embodiments which are described, without departing from the spirit and scope of the claimed invention.

What is claimed is:

1. An insulator, useful for supporting an electric cable, having a length, width, height, top, lengthwise and heightwise centerplane, opposing sides, opposing ends, and a transverse cross section, for use in supporting a cable on a nominally horizontal arm of a stanchion, which arm has a length, a lengthwise centerline, a lengthwise running top surface provided by at least two opposing-side lengthwise-running flanges, each flange having at least one lengthwise edge, and at least two opposing-side lengthwise and upwardly running surfaces, which insulator comprises:

a body having a width, a first lengthwise end, a second lengthwise end, a base plane, a top spaced apart vertically from the base plane, opposing sides running lengthwise, and an interior concavity, wherein each lengthwise end comprises at least a portion of a lower surface of the body lying in the base plane for at least partially supporting the body on the top surface of the stanchion arm;

at least two resiliently deflectable tabs spaced apart laterally, the tabs on opposing sides of said centerplane, each tab extending downwardly from the body to a point beyond said base plane, each tab having a lip shaped for engaging the lengthwise edge of an arm flange when the base plane is resting on the top surface of the arm; and, at least two legs spaced apart across the centerplane, each leg extending downwardly from the body to a point beyond said base plane, each leg having a surface running lengthwise, perpendicular to said base plane, and parallel to said length, the leg surface configured for slidably contacting a lengthwise upwardly-running surface of the arm when the base plane of the insulator is resting on the top surface of the arm.

2. The insulator of claim 1 wherein the body comprises ribbing within the concavity, the ribbing extending downwardly from the top to the base plane, wherein the ribbing forms a portion of said lower surface of the body.

3. The insulator of claim 2 wherein the wherein the ribbing comprises two lengthwise segments that each have a C shape in the base plane.

4. The insulator of claim 3 wherein the ribbing further comprises a plurality of link segments connecting each lengthwise segment to a body side.

5. The insulator of claim 1, configured for use on an arm having a U shape or other shape transverse cross section wherein the opposing side lengthwise flange edges which face the arm lengthwise centerline, wherein the lip of each tab faces outwardly from the lengthwise centerplane of the insulator and, wherein each leg surface is further from the centerplane than is each tab.

6. The insulator of claim 1, configured for use on an arm having a U shape or other shape transverse cross section wherein opposing side lengthwise flange edges which face away from the arm lengthwise centerline, wherein the lip of each tab faces inwardly toward the lengthwise centerplane of the insulator and, wherein each leg surface is closer to the centerplane than is each tab.

7. The insulator of claim 1, configured for an arm having a T shape or other shape transverse cross section wherein the opposing side flanges meet at the arm lengthwise centerline and the opposing side lengthwise flange edges face away from the arm lengthwise centerline, wherein the lip of each tab faces inwardly toward the lengthwise centerplane of the insulator and, wherein each leg surface is nominally the same distance from the lengthwise centerplane as is each tab.

8. The insulator of claim 1 wherein said top surface has a concave curve.

9. The insulator of claim 8 wherein the body has an interior concavity; wherein said top surface has at least one opening into said interior concavity proximate an insulator end.

10. The insulator of claim 1 configured for use on an arm wherein each flange at least one lengthwise edge faces inwardly toward the centerplane, thereby to define one or more lengthwise slot openings; wherein the lip of each tab faces outwardly with respect to the centerplane; and, wherein each said leg surface is further from the centerplane than is each said tab.

11. The insulator of claim 1 having four said legs and four said of resiliently deflectable tabs.

12. The insulator of claim 1 having two said leg surfaces, each leg surface running along the whole length of the body.

13. The insulator of claim 1 in combination with a cable rack that is comprised of at least one said stanchion and at least one said bracket comprising said arm, wherein the insulator is mounted on the top surface of the arm with the lip of each tab engaged with a lengthwise running edge of a flange; wherein each leg surface is in contact with a lengthwise and upwardly running surface of the arm; and wherein said insulator is movable lengthwise along the arm.

14. The insulator of claim 5 in combination with a cable rack that is comprised of at least one said stanchion and at least one said bracket comprising said arm, wherein the insulator is mounted on the top surface of the arm with the lip of each tab engaged with a lengthwise running edge of the flange; wherein each leg surface is in contact with a lengthwise and upwardly running surface of the arm; and wherein said insulator is movable lengthwise along the arm.

15. A method of supporting a horizontally running electric cable which comprises:

(a) providing a multiplicity of insulators in accord with claim 1, wherein each tab has a home position;

(b) providing a multiplicity of brackets mounted on a multiplicity of spaced apart said stanchions, each bracket comprising a said arm extending from a stanchion in a nominally horizontal orientation, the arms parallel to and spaced apart from each other;

(c) pressing each insulator downwardly onto each arm, so that each leg surface is in close proximity to a lengthwise and upwardly running surface so that each tab lip is resiliently deflected and then engaged with a flange lengthwise edge; said base plane contacts and rests upon said arm top surface; wherein the insulator is slidable along a portion of the length of the arm; and, (d) running at least one cable between the arms of said multiplicity of brackets so the cable rests on the top surface of each of each insulator.

16. A method of supporting a cable running horizontally in proximity to vertical supports which comprises:

(a) providing a multiplicity of insulators in accord with claim 2, wherein each tab has a home position;

(b) providing a multiplicity of brackets mounted on a multiplicity of spaced apart said stanchions, each bracket comprising a said arm extending from a stanchion in a nominally horizontal orientation, the arms parallel to and spaced apart from each other;

(c) pressing each insulator downwardly onto each arm, so that each leg surface is in close proximity to a lengthwise and upwardly running surface so that each tab lip is resiliently deflected and then engaged with a flange lengthwise edge; said base plane contacts and rests upon said arm top surface; wherein the insulator is slidable along a portion of the length of the arm; and, (d) running at least one cable between the arms of said multiplicity of brackets so the cable rests on the top surface of each of each insulator.

* * * * *